US008448292B2

(12) United States Patent
Miefalk et al.

(10) Patent No.: US 8,448,292 B2
(45) Date of Patent: May 28, 2013

(54) CYCLONE-LIKE SEPARATOR FOR A VACUUM CLEANER

(75) Inventors: Håkan Miefalk, Järfälla (SE); Tommy Lindquist, Farsta (SE); Anders Haegermarck, Trångsund (SE)

(73) Assignee: AB Electrolux, Stockholm (SE)

( * ) Notice: Subject to any disclaimer, the term of this patent is extended or adjusted under 35 U.S.C. 154(b) by 414 days.

(21) Appl. No.: 12/740,471

(22) PCT Filed: Oct. 27, 2008

(86) PCT No.: PCT/EP2008/009056

§ 371 (c)(1), (2), (4) Date: Sep. 7, 2010

(87) PCT Pub. No.: WO2009/056264

PCT Pub. Date: May 7, 2009

(65) Prior Publication Data

US 2010/0325834 A1 Dec. 30, 2010

Related U.S. Application Data

(60) Provisional application No. 60/983,391, filed on Oct. 29, 2007.

(30) Foreign Application Priority Data

Oct. 29, 2007 (SE) ..... 0702397

(51) Int. Cl.
*A47L 9/16* (2006.01)

(52) U.S. Cl.
USPC ..... 15/347; 15/353

(58) Field of Classification Search
USPC ..... 15/347, 352, 353; 55/418, 419
See application file for complete search history.

(56) References Cited

U.S. PATENT DOCUMENTS 3,568,847 A * 3/1971 Carr ..... 210/512.1
7,662,201 B2 * 2/2010 Lee ..... 55/419

FOREIGN PATENT DOCUMENTS

| | | |
|---|---|---|
| AU | 7763681 | 5/1983 |
| DE | 4136935 | 5/1993 |
| GB | 529692 | 11/1940 |
| GB | 2035150 | 6/1980 |
| GB | 2116457 | 9/1983 |
| SU | 1217487 | 3/1986 |

* cited by examiner

*Primary Examiner* — Dung Van Nguyen
(74) *Attorney, Agent, or Firm* — Hunton & Williams LLP

(57) ABSTRACT

A cyclone separator for a vacuum cleaner. The separator has a cyclone chamber, an air entrance device having a flow passage arrangement therethrough for introducing an air stream into the cyclone chamber in a manner that causes the air stream to swirl in the cyclone chamber to remove dust from the air stream, and an air outlet for emitting the air stream from the cyclone chamber. The entrance device has a control member that is operable to alter the flow passage arrangement such that one or more properties of the air stream in the cyclone chamber are affected by the alteration. The flow passage arrangement has a first path and a second path, and the control member is operable to alter the flow passage arrangement by redirecting the air stream from the first path to the second path.

20 Claims, 3 Drawing Sheets

CYCLONE-LIKE SEPARATOR FOR A VACUUM CLEANER

This application claims priority to International Application No. PCT/EP2008/009056 filed Oct. 27, 2008 (now WO 2009/056264), which claims priority to both Swedish Patent Application No. SE 0702397-1 filed Oct. 29, 2007 and U.S. Provisional Application No. 60/983,391 filed Oct. 29, 2007 both of which are incorporated herein by reference.

FIELD OF THE INVENTION

The present invention relates to a cyclone-like separator for a vacuum cleaner, wherein the cyclone-like separator is arranged to be mounted in an air stream of the vacuum cleaner. The present invention also relates to a vacuum cleaner and to a vacuum cleaner nozzle.

BACKGROUND ART

Generally, a vacuum cleaner draws a dust and debris containing air from a surface to be cleaned, separates at least some of the dust and debris from the drawn dust and debris containing air flow in a separating unit and releases an air flow relieved of the separated dust and debris to the surrounding air. Normally, the separated dust and debris is collected in the vacuum cleaner, for example in a compartment of the separating unit or in a separate compartment or container.

One known separating unit for a vacuum cleaner is a filter bag, which is a bag made of a suitable filter material. The filter bag is placed in the air flow through the vacuum cleaner such that the air flow is forced through the filter bag, wherein dust and debris contained in the air flow is trapped inside the filter bag and the remaining air flow continues to an outlet of the vacuum cleaner. When the filter bag is full, it normally is replaced by a new one, but there exists also filter bags which are of such quality that they can be emptied and cleaned for being reused several times.

Another known separating unit for a vacuum cleaner is a cyclone or a cyclone-like separator. A cyclone separator is mounted in the air flow of the vacuum cleaner, wherein an air stream passes through the cyclone separator. A cyclone separator normally comprises an air inlet for introducing a dust and debris containing air stream into a cyclone chamber. The dust and debris containing air stream makes a tangential entry through the air inlet into the cyclone chamber and swirls around in the cyclone chamber, whereby dust and debris are separated from the air stream due to centrifugal forces. Dust and debris are caught at the cyclone chamber wall and travel along the wall to the bottom of the cyclone chamber. Many cyclone separators are provided with a dust container into which dust and debris are thrown from the cyclone chamber bottom. The air stream, which has been relieved of dust and debris in the cyclone chamber, leaves the cyclone chamber through an air outlet and continues through the vacuum cleaner to an outlet thereof.

A problem with known cyclone or cyclone-like separators is that each specific cyclone or cyclone-like separator has a limited range of operation. For example, a cyclone separator can be designed to have a high separation efficiency, wherein the term efficiency is used in relation to the ability to separate fine particles. However, the high flow resistance of such cyclone separators limit their usability in situations when a high flow rate is needed. One such situation is normal vacuum cleaning, wherein a certain air flow through the nozzle is needed in order for the vacuum cleaner to be able to pick up dust and debris from the surface to be cleaned. On the other hand, a cyclone separator, which is designed to have a low flow resistance may have a separation efficiency that is too low for separating finer dust particles. Another example is the position of the air inlet of the cyclone, which restrains how the cyclone can be connected to an air stream through the vacuum cleaner.

SUMMARY OF THE INVENTION

It is therefore an object of the present invention to provide a cyclone-like separator, which may alleviate the above-mentioned problem.

According to the invention this object may be achieved by a cyclone-like separator according to claim 1.

According to a first aspect, the invention relates to a cyclone-like separator for a vacuum cleaner.

According to a second aspect, the invention relate to a vacuum cleaner comprising a cyclone-like separator according to the invention.

According a third aspect, the invention relates to a vacuum cleaner nozzle comprising the cyclone-like separator according to the invention.

Thus, the cyclone-like separator according to the invention is arranged to be mounted in an air stream of a vacuum cleaner and comprises a cyclone-like chamber, an air entrance device having a flow passage arrangement therethrough for introducing an air stream into the cyclone-like chamber, and an air outlet for emitting an air stream from the cyclone-like chamber. The air entrance device and the cyclone-like chamber are arranged such that a dust containing air stream entering the cyclone-like chamber through the entrance device is caused to swirl in the cyclone-like chamber, whereby dust is separated from the air stream. The air outlet and the cyclone-like chamber are arranged such that an air stream, which has been relieved of dust in the cyclone-like chamber, is discharged through the air outlet. The entrance device comprises a control member that is operable to alter the flow passage arrangement such that an air stream passing through the flow passage arrangement is affected by the alteration, whereby the cyclone-like chamber receives an altered air stream.

The invention is based on the general idea that the operation of a cyclone-like separator can be broadened by providing means for altering the characteristics of the air stream supplied to the cyclone-like chamber of the separator. Due to that, the entrance device, which has a flow passage arrangement therethrough for introducing an air stream into the cyclone-like chamber of the separator, comprises a control member, which, according to the invention, is arranged to be operable to affect the flow passage arrangement such the air stream entering the cyclone-like chamber is altered. The separator according to the invention may be operable with at least two different types of air streams. In addition, when the cyclone-like separator is mounted in a vacuum cleaner, the user can operate the control member to alter the air stream without operating any of the other control features of the vacuum cleaner, such as for example a power regulator. Thanks to that, the entrance device, which comprises the control member, is arranged to supply at least two different types of air streams to the cyclone-like chamber, the operation of the cyclone-like separator according to invention is not restricted to one, fixed design. Instead, the single cyclone-like separator according to the invention corresponds to at least two conventional cyclone-like separators having one entrance passage respectively, wherein the entrance passages affect an air stream passing therethrough differently. Consequently, the cyclone-like separator according to the invention can be designed to operate within a range substantially corresponding to the range of operation according to at least two conventional cyclone-like separators.

The entrance device can be arranged to alter the air stream, which is to be introduced into the cyclone-like chamber, in many different aspects. For example, a first air stream, which has a first characteristic and which flows through the entrance device into the cyclone-like chamber can, by means of the control member, be altered to a second air stream, which flows through an altered entrance device into the cyclone-like chamber and which has a second characteristic. The two air streams can differ with respect to flow rate, i.e. the volume of fluid which passes through a given surface per unit time. It is also possible to alter the flow passage of the entrance device such that the distribution of velocities in the air stream is altered. For example, an air stream can have a homogenous velocity distribution over a cross section of the stream, or the air stream can have different velocities at different points of a cross section thereof. Thus, an air stream having a homogenous velocity distribution can be altered to, for example, an air stream having higher velocities at points of the cross section thereof which are close to the inner wall surface of the cyclone-like chamber than points closer to the centre of the cyclone-like chamber. Another possibility to alter an air stream is to simply alter the location where the air stream is introduced into the cyclone-like chamber. Of course, an air stream can be altered in one or several aspects.

This altercation of the air stream can be achieved in many different ways, for example by altering the flow resistance of the entrance device or by affecting the entrance device such that entrance direction of the air stream into the cyclone-like chamber is altered, as will be described in more detail later on.

The alteration of the air stream which is introduced into the cyclone-like chamber will normally also bring about an altered operation of the cyclone-like separator. For example, an increase of the velocities in the air stream that are close to the inner wall surface of the cyclone-like chamber normally has the effect that the separation efficiency of the cyclone-like separator is increased with respect to the ability to separate fine particles. This is due to that finer particles normally have less weight and thus need higher speed in order for the centrifugal forces to be sufficient for forcing the fine particles against the inner wall surface of the cyclone-like chamber. A higher speed may also cause the finer particles to take swirling path that comprises more turns through the cyclone. The increase in speed will normally also effect that the flow resistance of the cyclone-like separator increases, whereby the volume flow therethrough decreases. However, the cyclone-like separator can be operated in a first mode where the separator has a lower efficiency and a lower flow resistance, and a second mode, where the separator has a higher efficiency and a higher flow resistance. The change in operation mode is affected by operating the control device.

A change in location for introducing the air stream into the cyclone-like chamber is advantageous in that the cyclone can be connected to different air intakes in a way involving a less complex pattern of air channels. This can be desirable for example for a cyclone in a vacuum cleaner or in a vacuum cleaner nozzle during carpet cleaning with a cleaning agent. In such applications, the air is preferably drawn into the vacuum cleaner through different air intakes when the vacuum cleaner operates in a cleaning agent dispensing mode and in a cleaning agent pick-up mode.

The invention relates to a cyclone-like separator. The invention also relates to a vacuum cleaner comprising a cyclone-like separator according to the invention. The vacuum cleaner can be of so-called canister type or of upright type.

The cyclone-like separator can be a part of the main separating unit of the vacuum cleaner or be arranged as an auxiliary separating unit in the vacuum cleaner. In vacuum cleaners, auxiliary separating units are sometimes employed for specific purposes other than main dust and debris separation during normal vacuum cleaning, for example for separating the cleaning agent during carpet cleaning with such a cleaning agent. An auxiliary separator can also be used as a pre-separator which is arranged upstream of the main separator, or as an additional separator for cleaning finer particles and being arranged downstream of the main separator. The separating unit can be arranged to function as a main separating unit in one position of the control member and to function as an auxiliary separating unit in another position of the control member.

According to the invention, the cyclone-like separator can be arranged in a vacuum cleaner nozzle.

The cyclone-like separator comprises a cyclone-like chamber. The separator and the chamber can be designed as a cyclone separator and a cyclone chamber respectively, or the separator and the chamber can be designed to operate in a cyclone-like manner, wherein the separator is arranged such that a debris and/or dust containing air stream passing through the cyclone-like separator is caused to swirl around in the chamber, whereby dust and debris is separated from the stream due to centrifugal forces.

The cyclone-like separator compromises an air outlet, wherein the air outlet and the cyclone-like chamber are arranged such that an air stream, which has been relieved of dust in the cyclone-like chamber, is discharged through the air outlet.

The cyclone-like separator can comprise a second outlet, a dust outlet through which dust and debris which have been separated from an air stream in the cyclone-like chamber is thrown out from the cyclone-like chamber. The dust outlet can be connected to a dust container for collecting the dust and debris, wherein the dust container can be comprised in the cyclone-like separator or constitute a separate unit. The dust container can have a closable opening for emptying purposes.

The cyclone-like separator comprises a cyclone-like chamber which is arranged for any suitable swirling motion of the air stream. For example, the cyclone-like chamber can be designed as a chamber where the main flow direction follows a screw-threaded type line and the main flow direction remains unchanged during passage through the cyclone-like chamber. It is also possible that the air enters and leaves the cyclone at the same end thereof, wherein thus the axial flow direction of the swirling air, or in other words the vortex, is reversed at a bottom of the cyclone-like chamber.

The cyclone-like chamber can have any suitable shape, for example a mainly cylindrical or mainly frusto-conical shape. It is also possible that the chamber has a cylindrical part and a frusto-conical part, which is often used in cyclone separators having a high ability to separate fine dust particles.

According to the invention, the cyclone-like chamber is provided with an altered air stream by the control member affecting the flow passage arrangement of the entrance device. The air stream is affected in a point just before entering the cyclone-like chamber at the latest. Normally the control member will be movable between at least two positions, such that after the control member has been operated to alter the entrance device in order to affect an air stream passing therethrough by being moved to a second position, the control member can be moved back to the first position, wherein the original air stream is supplied to the cyclone-like chamber again.

The flow passage arrangement can comprise one or several separate flow channels or constitute just a single adjustable air inlet in the wall of the cyclone-like chamber. The flow passage arrangement can have a single flow passage leading to one or several air inlets in the wall of the cyclone-like chamber. The flow passage arrangement can comprise several flow passages leading to one single air inlet in the wall of the cyclone-like chamber or to one air inlet respectively.

The control member can be arranged to affect the flow passage arrangement in any way that has effect on an air stream flowing therethrough. Normally, the control member is arranged to act on the flow resistance of the flow passage arrangement such that the desired alteration of the air stream is achieved. The flow resistance of the flow passage arrangement can be altered by altering the dimension of the flow passage arrangement with respect to height, width and/or curvature thereof in at least one location along the flow passage arrangement. For example, an increase in speed of an air stream can be achieved by decreasing the dimensions of the flow passage arrangement. Another possibility is to design the flow passage arrangement with two (or several) flow paths therethrough, wherein each flow path has a different effect on an air stream passing through. The flow paths can differ with respect to length, cross section dimensions or characteristic of the inner surface wall, for example.

The control member can be any suitable flow altering device. The control member can be any type of movable mechanical device for opening, shutting or partly obstructing one or more ports or paths of the flow passage arrangement. The control member can comprise a valve member. The control member can comprise one or several valve members, which can be placed at different locations of the flow arrangement. Thus, the operation of the control member can include the operation of several valve members which are arranged to obstruct/open a path, redirect an air stream, or both, wherein an air stream passing through the flow passage arrangement of the entrance device is altered before being introduced into the cyclone-like chamber.

The control member can be arranged to alter the flow passage in a step wise manner or be arranged to continuously alter the flow condition in the flow passage arrangement.

According to the invention, the control member can be operated manually or be controlled by a mechanical or electrical control unit. The operation of the control member can be automatic, in response to any suitable parameters of the vacuum cleaner or vacuum cleaning operation. To this end, the control unit can be provided with a programmable computer or a micro processor.

According to an embodiment of the invention, the flow passage arrangement comprises an air inlet in the wall surface of the cyclone-like chamber, where through a dust and/or debris containing air stream is to be introduced into the cyclone-like chamber. A valve member is provided at the air inlet, which is operable to alter the conditions at the air entrance such that an air stream passing therethrough is affected and an altered air stream is introduced into the cyclone-like chamber. The valve member can be operable to alter the dimensions of the air inlet by partly covering it.

An advantage with an air inlet that is provided with an air inlet having alterable dimensions is that, if larger piece of debris or dust gets stuck at the inlet, the air inlet can be widened such that the stuck piece can slip through the air inlet into the cyclone-like chamber and there be separated from the air stream. Thus, the cyclone-like separator can be designed to, during normal operation, have a smaller air inlet than conventional cyclone-like separators since also larger pieces of debris need to be able to pass through the fixed air inlet of conventional cyclone-like separators.

According to an embodiment of the invention having an air inlet in the wall surface of the cyclone-like chamber, the air inlet can be provided with a direction guide which directs the air stream towards the inner wall surface of the cyclone-like chamber. Such embodiments of the invention can be provided with a control member acting on the guide to change the angle thereof, wherein the angle of incidence of the air stream on the inner wall surface of the cyclone-like chamber can be altered.

According to an embodiment of the invention, the flow passage arrangement comprises a first and a second air inlet in the wall surface of the cyclone-like chamber, where through a dust and/or debris containing air stream is to be introduced into the cyclone-like chamber. However, the control member is operable to alter the distribution of how much of the air stream enters the cyclone-like chamber through the first and the second air stream. The control member can comprise a valve member, which is arranged to open the first air inlet and, at the same time, close the second air inlet, wherein an air stream can be redirected such that it enters the cyclone-like chamber through the second air inlet instead of through the first air inlet, and a vice versa. The control member can be provided at the air inlets.

Thus, one way to achieve an altered air stream is to redirect the air stream from a first air inlet to a second air inlet, wherein the second air inlet differs from the first air inlet at least by the location thereof, but which can also differ with respect to dimensions and/or angles. Another way can be to have only a single, adjustable air inlet. Of course, the flow passage of the entrance device can comprise more than two paths and air inlets.

BRIEF DESCRIPTION OF THE DRAWINGS

The invention may be performed in many various ways, and by way of example only, an embodiment thereof will now be described in detail with reference to the accompanying drawings, in which.

DETAILED DESCRIPTION OF PREFERRED EMBODIMENTS OF THE INVENTION

Figure 1:
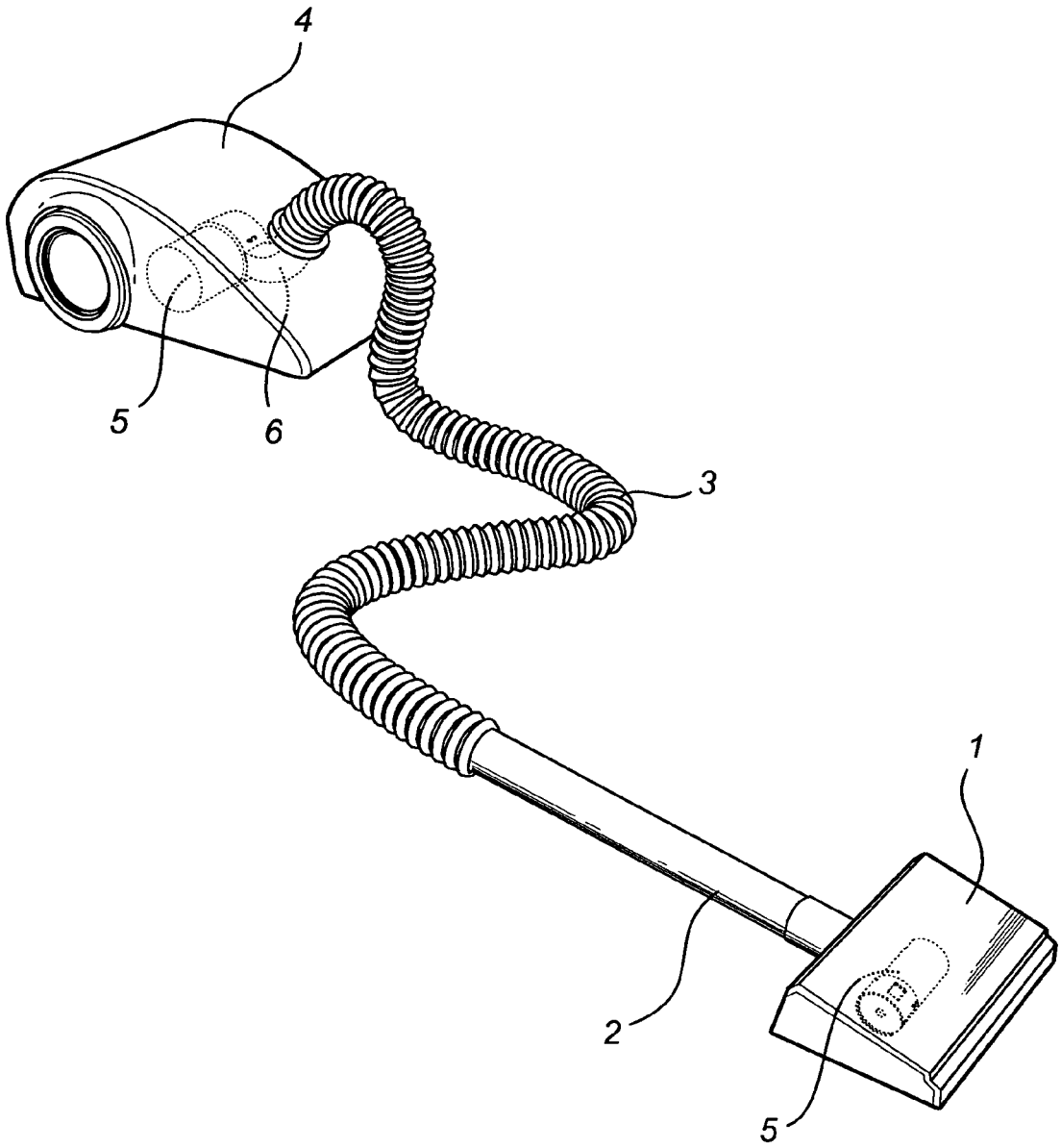
FIG. 1 is a schematic perspective view of an embodiment of a vacuum cleaner of canister type having a cyclone-like separator according to the invention, wherein a first cyclone-like separator is arranged in the vacuum cleaner as a main separating unit, and a second cyclone-like separator is arranged in the vacuum cleaner as an auxiliary separating unit.

With reference to FIG. 1, a vacuum cleaner according to the invention is shown, wherein the vacuum cleaner is of canister type. The vacuum cleaner comprises a nozzle 1, which is connected to a first end of a tube 2. A second end of the tube 2 is connected to a first end of a hose 3, and a second end of the hose 3 is connected to a vacuum cleaner body 4. The vacuum cleaner body 4 comprises a vacuum source (not shown) which is arranged to draw a dust and debris containing air stream through the nozzle 1, the tube 2 and the hose 3. The air stream passes through the vacuum cleaner body 4, where it is relieved of dust and debris and continues to an outlet (not shown) of the vacuum cleaner.

A first cyclone-like separator in the form of a cyclone separator 5 according to the invention is provided in the vacuum cleaner nozzle 1, wherein the first cyclone separator 5 is arranged such that the air stream drawn into the vacuum cleaner passes through the first cyclone separator 5 before leaving the nozzle 1. The first cyclone separator according to the described embodiment of the invention is arranged in the nozzle for separating a cleaning agent in form of a cleaning agent powder during corresponding carpet cleaning. For this application, the cyclone separator according to the invention is advantageous because the air stream can be introduced into the cyclone chamber at two different location depending on if powder is dispensed or picked up. However, the skilled person realizes that also other applications for a cyclone-like separator 5 in a nozzle 1 are possible. Thus, the cyclone separator can be arranged in the nozzle as a pre-separator which, for example, is switchable between two different separation efficiency modes.

A second cyclone-like separator according to the invention in form of a cyclone separator 5 according to the invention is provided in the vacuum cleaner body 4. The second cyclone separator 5 is arranged in the vacuum cleaner body 4 in order to operate as the main separating unit of the vacuum cleaner. The dust and debris containing air stream is drawn into the vacuum cleaner body through the hose 3, and is supplied to the second cyclone separator 5 through an air channel 6. The dust and debris containing air stream passes through the cyclone separator 5, wherein the dust and debris containing air stream is relieved of dust and debris, before continuing through the vacuum cleaner body 4 to the outlet. The second cyclone separator 5 according to the described embodiment of the invention is arranged in the vacuum cleaner as a main separating unit, wherein the operation thereof enables a shifting between a first type of air stream and a second type of air stream. Thus, the operation of the main separating unit can be altered to suit specific purposes corresponding to the type of air stream, for example a high efficient separation mode and a low efficient separation mode. However, the skilled person realizes that the air stream can be adjusted for other applications also.

While the described embodiment of a vacuum cleaner according to the invention comprises two cyclone separators according to the invention, other embodiments can have only one cyclone separator.

Figure 2:
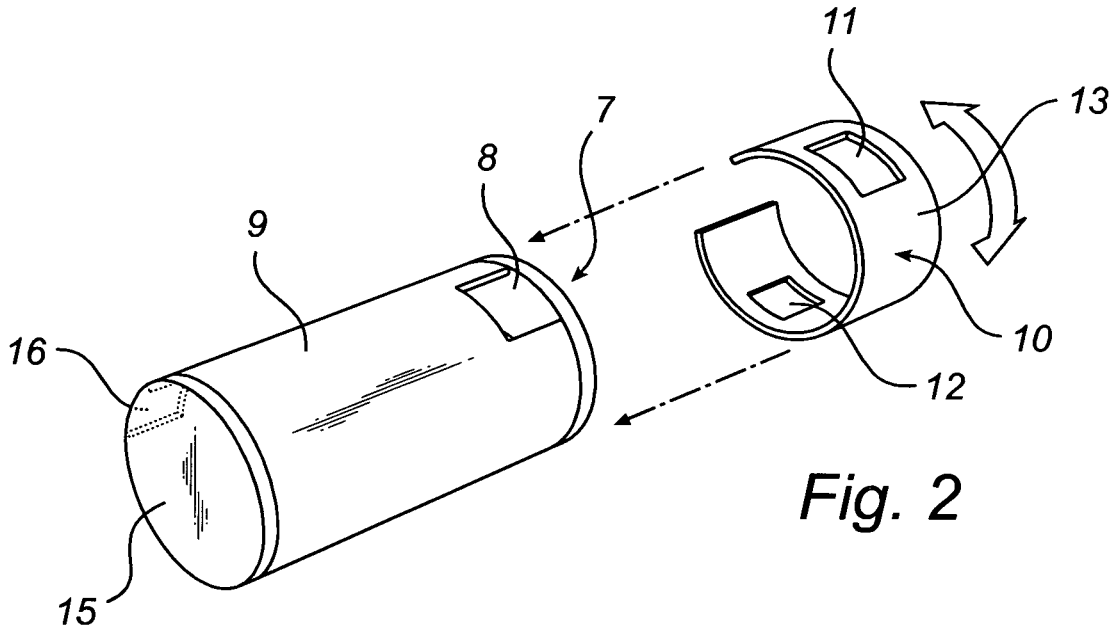
FIG. 2 is a schematic perspective view of a first embodiment of the cyclone-like separator according to the invention.

In FIG. 2, a first embodiment of the cyclone-like separator 5 according to the invention is shown. The cyclone-like separator 5 is a cyclone separator which can be mounted in an air stream of a vacuum cleaner at any suitable position and any purpose which is suitable for the types of air streams that are available in this embodiment. The cyclone-like separator 5 has cyclone-like chamber in form of a cyclone chamber 7. The cyclone separator 5 comprises an air entrance device comprising a flow passage arrangement therethrough, wherein the flow passage arrangement includes an air inlet 8, which is provided in a wall surface 9 of the cyclone chamber 7.

The air entrance device further comprises a control member in the form of a valve member 10. The valve member 10 comprises a collar element 13, which is provided with a first opening 11 and a second opening 12. The first opening 11 is larger than the second opening 12, wherein the first opening 11 extends a greater distance along the circumference of the collar element 13. The collar element 13 is mounted over and extends partly around the surface wall 9 of the cyclone chamber 7, wherein the air inlet 8 is located under the collar element 13.

Figure 3:
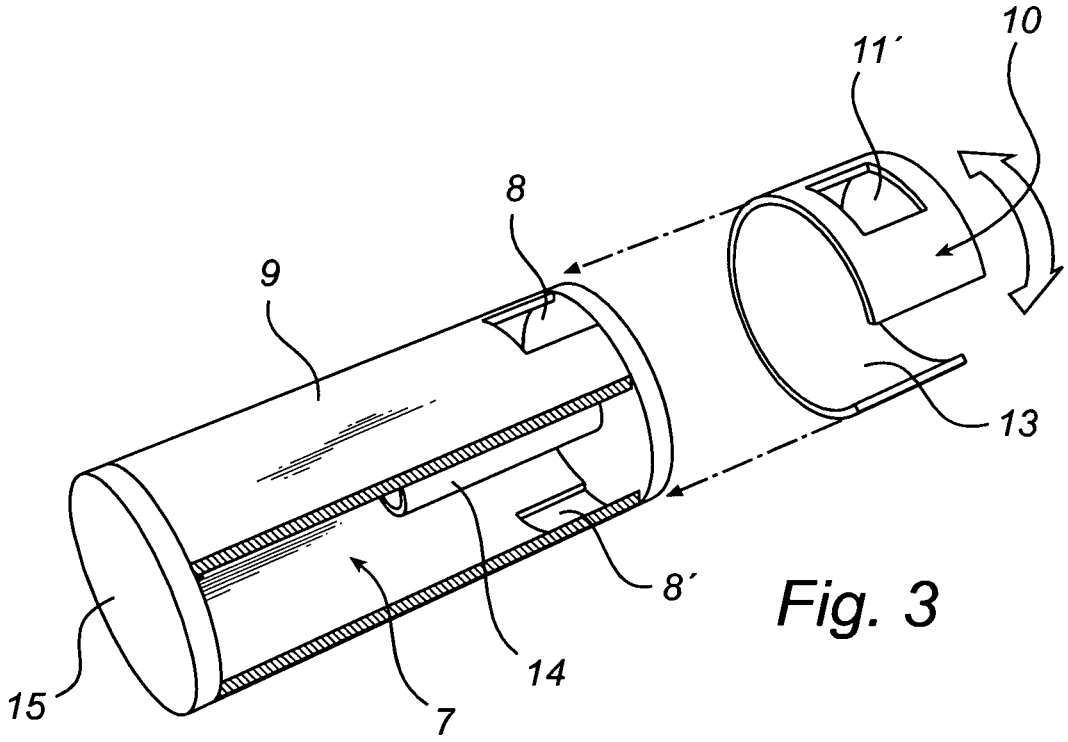
FIG. 3 is a schematic perspective view of a second embodiment of the cyclone-like separator according to the invention.

The cyclone-like separator 5 according to the first embodiment of the invention comprises further an outlet 14 of the same kind as in the second embodiment of the cyclone-like separator shown in FIG. 3, i.e. an outlet 14 having the shape of a small cylinder which extends a small distance into the cyclone-chamber 7. The outlet 14 and the air inlet 8 are provided at the same end of the cyclone chamber 7.

The cyclone chamber 7 has a closed bottom 15. A dust outlet opening 16 is provided in the wall surface 9 at the bottom end of the cyclone chamber 7.

Figure 4A:
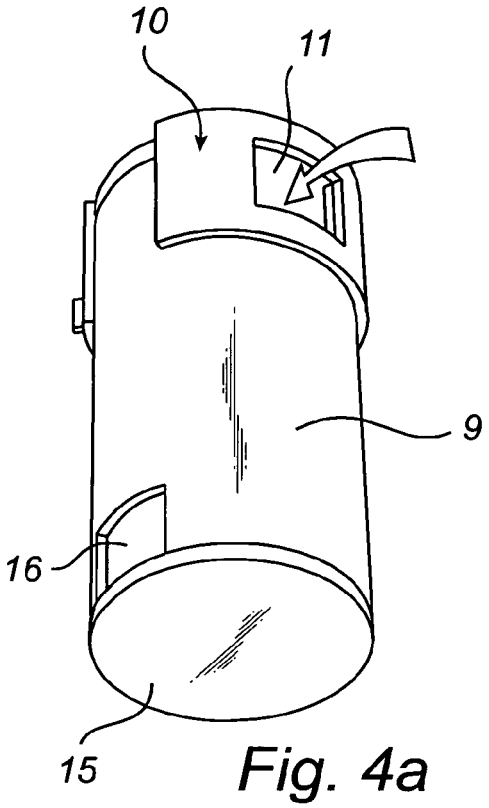
FIGS. 4*a* and 4*b* are schematic perspective views showing the operation of a control member of the cyclone-like separator according to the first embodiment of invention.
Figure 4B:
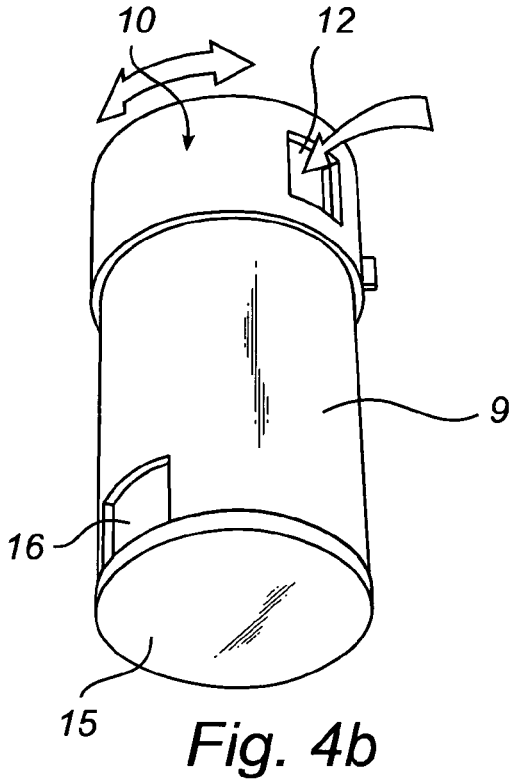

With reference to FIGS. 4*a* and 4*b*, the operation of the cyclone separator 5 according to the first embodiment will be described.

In FIG. 4*a*, the cyclone separator 5 operates in a first mode. The valve member 10 is in a first position, where the first opening 11 is aligned with the air inlet 8. Thus, when a dust and debris containing air stream is supplied to the cyclone separator 5, the air stream passes through the first opening 11 and the air inlet 8 into the cyclone chamber 7. The dust and debris containing air stream makes a tangential entry into the cyclone chamber, wherein the air stream has a first characteristic with respect to flow rate, velocity distribution and angle of incidence with the inner wall surface of the cyclone chamber wall 9. The air stream swirls around in the cyclone chamber 7, whereby dust and debris are separated from the air stream due to centrifugal forces. Dust and debris are caught at the cyclone chamber wall 9 and travel along the wall 9 to the bottom 15 of the cyclone chamber 7. At the bottom 15, the dust and debris are thrown out from the cyclone chamber 7 through the dust outlet opening 16. The air stream, which has been relieved of dust and debris in the cyclone chamber, leaves the cyclone chamber through the air outlet 14.

When it is desired to alter the operation of the cyclone separator 5 to a second mode, the valve member 10 is operated by rotating the collar element 13 such that the second opening 12 is aligned with the air inlet 8, c.f. FIG. 4*b*. Thus, when a dust and debris containing air stream is supplied to the cyclone separator 5, the air stream passes through the second opening 12 and the air inlet 8 into the cyclone chamber 7. Due to the second opening 12 having different dimensions than the first opening 11, the air stream passing through the entrance device, which comprises the flow passage arrangement in form of the air inlet 8 and the control member in form of the valve member 10, is affected by the operation of the valve member 10. In this embodiment, the dimensions of the flow passage arrangement are altered by altering the size of the air inlet by means of the valve member 10. The dust and debris containing air stream which makes a tangential entry into the cyclone chamber through the second opening 12 and the air inlet 8, has, due to the smaller size of the opening 12, a second characteristic with respect to flow rate, velocity distribution and angle of incidence with the inner wall surface of the cyclone chamber wall 9. Thus, the air stream of the second characteristic swirls around in the cyclone chamber 7 in a different manner, whereby dust and debris of another fraction can be separated from the air stream. Consequently, the cyclone separator will operate in a second mode. The separated dust and debris are thrown out from the cyclone chamber 7 through the dust outlet opening 16. The air stream, which has been relieved of dust and debris in the cyclone chamber, leaves the cyclone chamber through the air outlet 14.

The cyclone separator, in both modes thereof, operates as a cyclone where the air enters and leaves the cyclone at the same end thereof, wherein thus the axial flow direction of the swirling air is reversed at a bottom of the cyclone-like chamber.

In FIG. 3, a second embodiment of the cyclone separator 5 according to the invention is shown. The second embodiment differs from the first embodiment described above, in that the flow passage arrangement includes a first air inlet 8 and a second air inlet 8'. The air inlets 8, 8' are provided in the wall surface 9 of the cyclone chamber 7 and differ with respect to location and size. The cyclone separator according to the second embodiment comprises a control member in form of a valve member 10, which is similar to that of the first embodiment. However, the collar member 13 according to the second embodiment, is provided with only one opening 11'.

In this embodiment, the control member is operable to alter the flow passage in that the collar element can be rotated such that in a first position, the first air inlet 8 is aligned with the opening 11' and the second air inlet 8' is closed by a portion of the collar element 13, and such that in a second position, the first air inlet 8 is closed by a portion of the collar element 13 and the second air inlet 8 ' is aligned with the opening 11'. Thus, by operating the valve member, the flow passage arrangement is affected such that the cyclone chamber 7 will receive an altered air stream, wherein the air stream is altered due to being introduced at a different location and due to having passed a narrower flow passage. The valve member 10 of the second embodiment is also an example of a control member which is operable to redirect an air stream from a first air inlet 8 to a second air inlet 8', wherein the characteristic of the air stream is altered.

Figure 5:
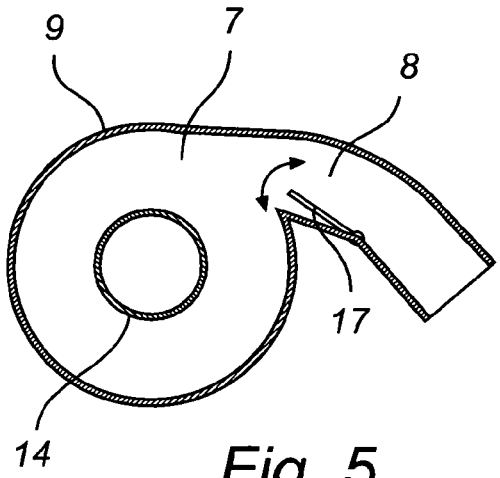
FIG. 5 is a schematic cross sectional view of a third embodiment of the cyclone-like separator according to the invention.
Figure 6:
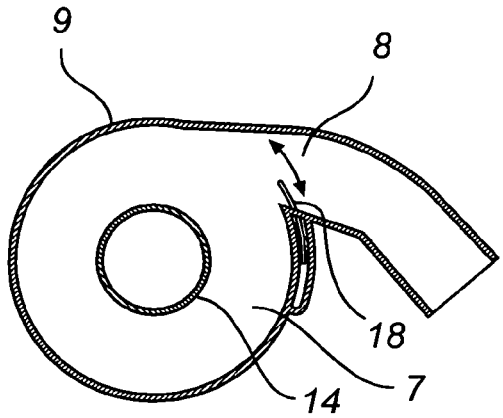
FIG. 6 is a schematic cross sectional view of a fourth embodiment of the cyclone-like separator according to the invention.

In FIGS. 5 and 6, third and fourth embodiments of the invention are shown, wherein these embodiments differ from the first and second embodiment described above substantially only in the construction of the control member and flow passage arrangement.

FIGS. 5 and 6 are cross sectional views of the respective embodiments of the cyclone separator 5 according to the invention, wherein the air outlet 14, the cyclone chamber 7, the wall 9 of the cyclone chamber 7 and a flow passage arrangement including the air inlet 8 are visible.

In the embodiment according to FIG. 5, the control member comprises a pivotable flap 17. The flap 17 is operable to alter the entrance angle of an air stream passing through the air inlet, wherein, in addition, the angle of incidence of the air stream on the inner wall surface 9 of the cyclone chamber 7 is altered. Consequently, the control member 17 of this third embodiment is operable to alter the flow passage such that an air stream passing therethrough is affected.

In the embodiment according to FIG. 6, the control member comprises a slidable gate 18. The sliding gate is operable to alter the size of the air inlet 8 being pushed into the air inlet 8 or by being pulled out thereof. The size of the air inlet 8 is continuously variable by the sliding gate 17. Consequently, the control member 17 of this fourth embodiment is operable to alter the flow passage such that an air stream passing therethrough is affected, wherein the cyclone chamber can be provided with an air stream which is continuously variable.

The described embodiments show a few examples of how a control member and flow passage can be arranged in order to achieve the desired alteration of the air stream which is to be introduced into the cyclone chamber 7. However, the skilled person will realize that many other arrangements are possible. For example, the sliding gate 17 of the fourth embodiment could also be slidably arranged in the axial direction of the cyclone chamber. It would also be possible to continuously vary an inlet with the collar element of the first and the second embodiment. Embodiments are also possible, where two or several of the described embodiments are combined.

The invention claimed is:

1. A cyclone separator for a vacuum cleaner, wherein the cyclone separator is arranged to be mounted in an air stream of the vacuum cleaner, the cyclone separator comprising:

a cyclone chamber;

an air entrance device having a flow passage arrangement therethrough for introducing an air stream into the cyclone chamber in a manner that causes the air stream to swirl in the cyclone chamber to thereby remove dust from the air stream;

an air outlet for emitting the air stream from the cyclone chamber; wherein the entrance device comprises a control member that is operable to alter the flow passage arrangement such that one or more properties of the air stream in the cyclone chamber are affected by the alteration, and wherein the flow passage arrangement comprises a first path and a second path, and wherein the control member is operable to alter the flow passage arrangement by redirecting the air stream from the first path to the second path.

2. The cyclone separator according to claim 1, wherein the one or more properties affected by the alteration comprise the flow rate of the air stream passing through the flow passage and entering the cyclone chamber.

3. The cyclone separator according to claim 1, wherein the one or more properties affected by the alteration comprise a distribution of flow velocities of the air stream passing through the flow passage and entering the cyclone chamber.

4. The cyclone separator according to claim 1, wherein the one or more properties affected by the alteration comprise a location at which the air stream enters the cyclone chamber.

5. The cyclone separator according to claim 1, wherein the control member is operable to alter the flow passage arrangement by altering the flow resistance of the flow passage arrangement.

6. The cyclone separator according to claim 1, wherein the control member is operable to alter the flow passage arrangement by altering the dimensions of the flow passage arrangement in at least one location along the flow passage arrangement.

7. The cyclone separator according to claim 6, wherein the control member is operable to alter the dimension of the flow passage arrangement with respect to a height, a width and/or a curvature thereof, at a location where the air stream is introduced into the cyclone chamber.

8. The cyclone separator according to claim 1, wherein the flow passage arrangement comprises at least a first air inlet provided in a wall surface of the cyclone chamber.

9. The cyclone separator according to claim 8, wherein the flow passage arrangement further comprises at least a second air inlet provided in the wall surface of the cyclone chamber, and wherein the first path and the second path lead to the first air inlet and the second air inlet, respectively.

10. The cyclone separator according to claim 9, wherein the first air inlet and the second air inlet have different dimensions.

11. The cyclone separator according to claim 10, wherein the control member comprises a rotatable collar mounted over the cyclone chamber following, at least partly, the surface wall of the cyclone chamber, and which is arranged to selectively cover the first air inlet and the second air inlet, wherein the collar is provided with at least one opening, which, when the collar is rotated, is movable from the first air inlet to the second air inlet.

12. A cyclone separator for a vacuum cleaner, wherein the cyclone separator is arranged to be mounted in an air stream of the vacuum cleaner, the cyclone separator comprising:

a cyclone chamber;

an air entrance device having a flow passage arrangement therethrough for introducing an air stream into the cyclone chamber in a manner that causes the air stream to swirl in the cyclone chamber to thereby remove dust from the air stream, the flow passage arrangement comprising a first passage, a second passage, a third passage and a control member movable between a first position in which the first passage and the second passage are fluidly connected to form a first air entry path into the cyclone chamber, and a second position in which the first passage and the third passage are fluidly connected to form a second air entry path into the cyclone chamber; and an air outlet for emitting the air stream from the cyclone chamber; wherein at least one property of the air stream is altered by moving the control member between the first position and the second position.

13. The cyclone separator according to claim 12, wherein the at least one property comprises a flow rate, a distribution of flow velocities, or an entrance location.

14. The cyclone separator according to claim 12, wherein the first passage is provided on a rotatable collar mounted over the cyclone chamber and the second passage and the third passage are provided through a wall of the cyclone chamber.

15. The cyclone separator according to claim 12, wherein the first passage is provided through a wall of the cyclone chamber, and the second passage and the third passage are on a rotatable collar mounted over the cyclone chamber.

16. The cyclone separator according to claim 12, wherein the second passage and the third passage have different dimensions.

17. A vacuum cleaner comprising:

a cyclone chamber;

an air entrance device having a flow passage arrangement therethrough for introducing an air stream into the cyclone chamber in a manner that causes the air stream to swirl in the cyclone chamber to thereby remove dust from the air stream;

an air outlet for emitting the air stream from the cyclone chamber; wherein the entrance device comprises a control member that is operable to alter the flow passage arrangement such that one or more properties of the air stream in the cyclone chamber are affected by the alteration, and wherein the flow passage arrangement comprises a first path and a second path, and wherein the control member is operable to alter the flow passage arrangement by redirecting the air stream from the first path to the second path.

18. The vacuum cleaner according to claim 17, wherein the cyclone separator, in at least in one position of the control member, is arranged to operate as a main separating unit of the vacuum cleaner.

19. The vacuum cleaner according to claim 17, wherein the cyclone separator, in at least in one position of the control member, is arranged to operate as an auxiliary separating unit of the vacuum cleaner.

20. The vacuum cleaner according to claim 17, wherein the vacuum cleaner comprises a nozzle, and the cyclone separator is arranged in the nozzle.

* * * * *